US007117705B2

(12) United States Patent
Clark

(10) Patent No.: US 7,117,705 B2
(45) Date of Patent: Oct. 10, 2006

(54) ADJUSTABLE CUTOFF

(75) Inventor: Michael C. Clark, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 126 days.

(21) Appl. No.: 10/993,161

(22) Filed: Nov. 19, 2004

(65) Prior Publication Data

US 2005/0150269 A1 Jul. 14, 2005

Related U.S. Application Data

(60) Provisional application No. 60/524,004, filed on Nov. 21, 2003.

(51) Int. Cl.
*B21D 5/04* (2006.01)
*B26D 1/24* (2006.01)

(52) U.S. Cl. ..... 72/294; 72/319; 83/502; 83/508.2

(58) Field of Classification Search ..... 72/294, 72/319; 83/698.61, 500–502, 504, 507, 508.2
See application file for complete search history.

(56) References Cited

U.S. PATENT DOCUMENTS 3,532,019 A * 10/1970 Metzger et al. ..... 83/502
3,905,264 A * 9/1975 Eddy ..... 83/481
4,428,265 A * 1/1984 Bolton ..... 83/502
5,724,740 A * 3/1998 Bishop ..... 30/375
6,000,268 A * 12/1999 Van Cleave et al. ..... 72/211

* cited by examiner

*Primary Examiner*—Daniel C. Crane
(74) *Attorney, Agent, or Firm*—Howard & Howard Attorneys, P.C.

(57) ABSTRACT

A cutting assembly (20) is removably supported on a sheet bending brake (24) for cutting a work piece (22). The cutting assembly (20) includes a cutter body (32), and a first (42) and a second cutting disk (48), each having an outer periphery defining a primary (44) and a complimentary cutting edge (50) respectively. The first (42) and second cutting disks (48) are rotatably supported by the cutter body (32) and rotate about a first axis (46) and a second axis (52) respectively. An adjustment mechanism (60) interconnects the second cutting disk (48) and the cutter body (32) for axially adjusting the complimentary cutting edge (50) with respect to the primary cutting edge (44) without having to remove the second cutting disk (48) from the cutter body (32). The cutting assembly (20) includes a locking device (82) for preventing movement of the adjustment mechanism (60) relative to the cutter body (32).

35 Claims, 4 Drawing Sheets

FIG - 6
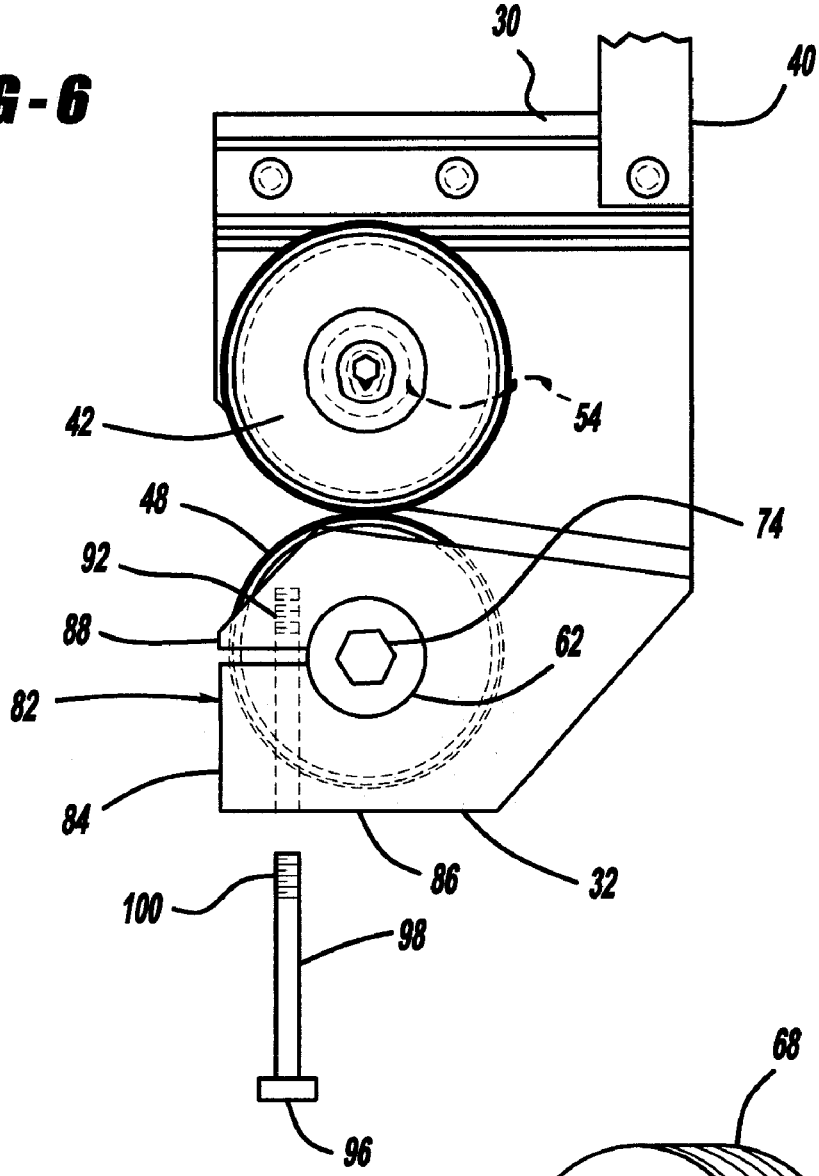
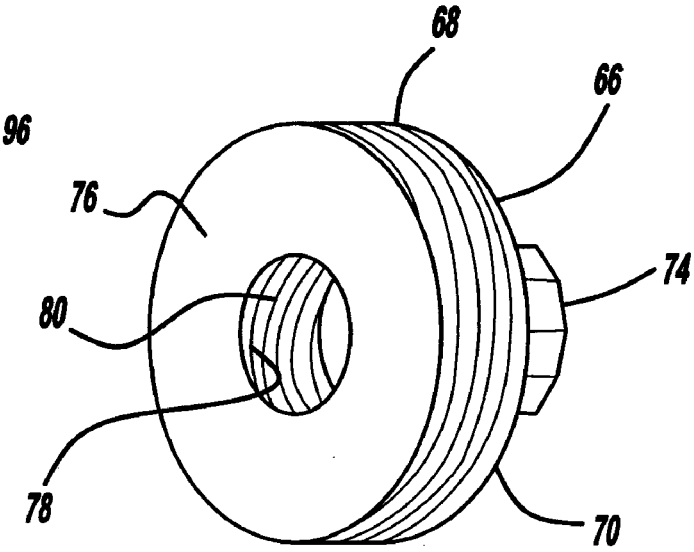
FIG - 5

ADJUSTABLE CUTOFF

RELATED APPLICATION

This application claims the benefit of the advantages and disclosure of U.S. provisional patent application Ser. No. 60/524,004, filed on Nov. 21, 2003, hereby incorporated by reference.

BACKGROUND OF THE INVENTION

1. Field of the Invention

The subject invention relates to a cutting assembly for cutting a work piece on a sheet bending brake.

2. Description of the Prior Art

It is well known to use a sheet bending brake to position and secure a work piece to assist a worker in cutting the work piece. The sheet bending brake includes a base, a clamping member attached to the base for clamping the work piece in place, and a bending member attached to the base for bending the work piece about a bending edge. One commonly known method for cutting the work piece includes scoring the work piece with a utility knife and then bending the work piece back and forth about the bending edge along the score line until the work piece breaks. The method forms an edge on the work piece that is not accurate or smooth, and leaves a rolled edge. Additionally, the method is time consuming, and the repeated use of the utility knife eventually damages an edge of the clamping member. This reduces the useful life of the sheet bending brake.

Alternatively, U.S. Pat. No. 5,582,053 to Chubb (the '053 patent), discloses a hand-operated cutting assembly that is removably mounted on the sheet bending brake. The cutting assembly quickly and accurately cuts the work piece, while leaving a smooth, flat edge; and not damaging the sheet bending brake. The cutting assembly includes a cutter body and two identical cutting disks. Each cutting disk has a cooperating cutting edge spaced from the other and separated from the cutter body by a spacer disposed between the cutting disk and the cutter body. The cutter assembly is able to cut a variety of work pieces, each having a different thickness, and manufactured from a different material. However, the ability of the cutting assembly to cut the variety of work pieces of different thickness' is dependent upon the spacing between the cooperating cutting edges. In order to change the spacing between the cooperating cutting edges to accommodate the work piece having a different thickness, one of the cutting disks must be removed and the spacer separating the cutting disk from the cutter body must be replaced with a spacer having a different thickness. This is a time consuming task and requires that spacers of varying thickness be readily available.

SUMMARY OF THE INVENTION AND ADVANTAGES

The subject invention provides a cutting assembly for cutting a work piece on a sheet bending brake. The assembly includes a cutter body. A first cutting disk, having a periphery defining a primary cutting edge, is rotatably mounted to the cutter body for rotation about a first axis. A second cutting disk, having a periphery defining a complimentary cutting edge, is rotatably mounted to the cutter body for rotation about a second axis. The first axis is spaced from the second axis for cutting the work piece therebetween. An adjustment mechanism interconnects the second cutting disk and the cutter body. The adjustment mechanism adjusts the complimentary cutting edge axially along the second axis relative to the primary cutting edge, and allows the cutting of a plurality of work pieces of different thickness and material.

Accordingly, the subject invention provides a cutting assembly for a sheet bending brake. The cutting assembly allows the distance between the cutting edges of the cutting disks to be quickly and easily adjusted relative to each other without having to remove one of the cutting disks or maintaining a variety of spacers, each having a different thickness, readily available.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a perspective view of the threaded insert; and FIG. 6 is a side view of a cutter body of the cutting assembly with a first cutting disk and a second cutting disk rotatably attached thereto.

DETAILED DESCRIPTION OF THE PREFERRED EMBODIMENT

Figure 1:
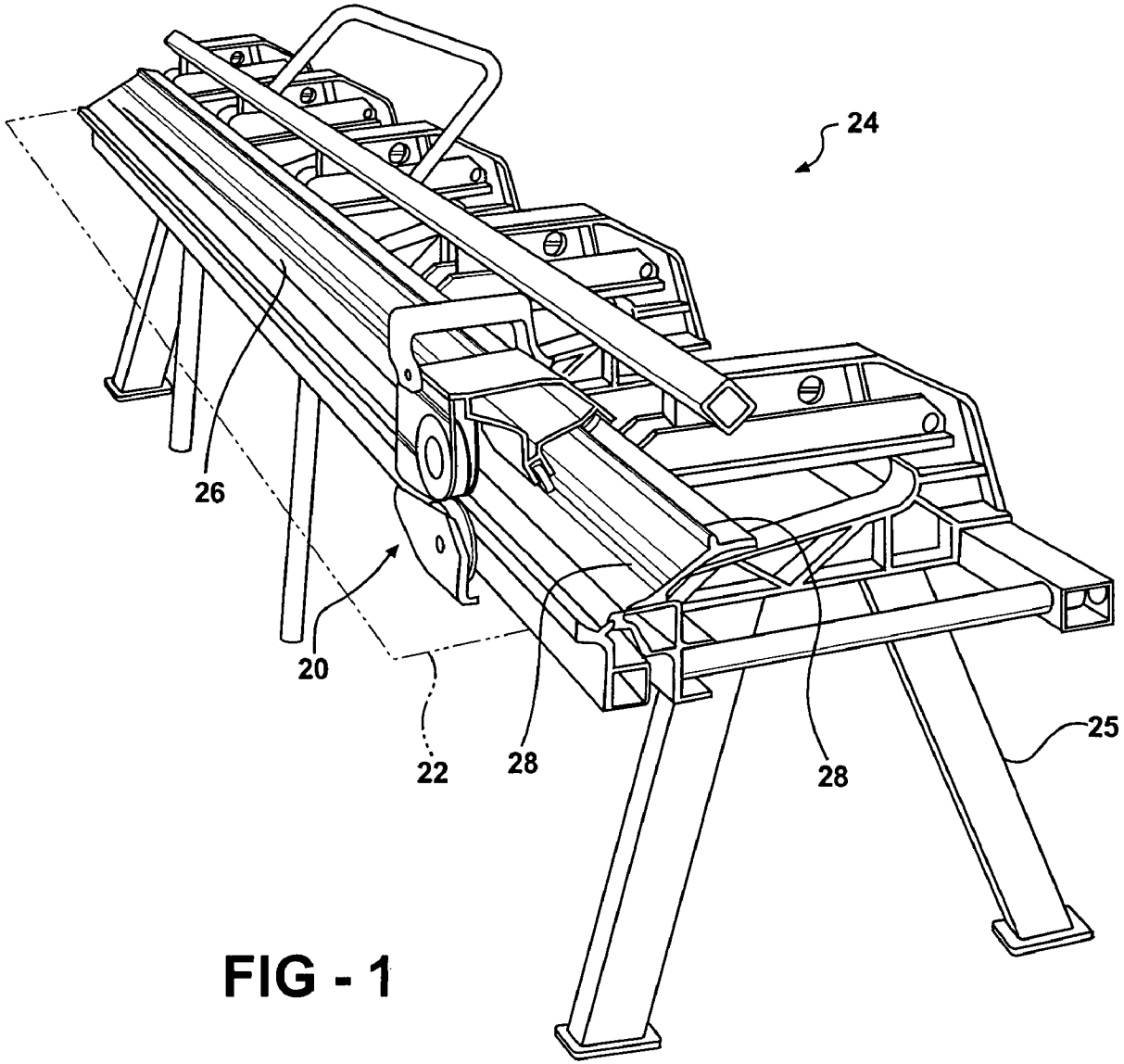
FIG. 1 is a perspective view of a cutting assembly removably supported on a sheet bending brake.

The subject invention provides a cutting assembly, generally shown at 20, for cutting a work piece 22 on a sheet bending brake, generally shown at 24 in FIG. 1. The cutting assembly 20 is contemplated for use with a typical sheet bending brake 24, such as disclosed in U.S. Pat. No. 5,582,053 (the '053 patent), the description of which is herein incorporated by reference.

The typical sheet bending brake 24, such as disclosed in the '053 patent, includes a base 25. A clamping member 26 is pivotally attached to the base 25 for securing the work piece 22 to the base 25. A track 28 extends longitudinally along the base for removably supporting the cutting assembly 20.

Figure 2:
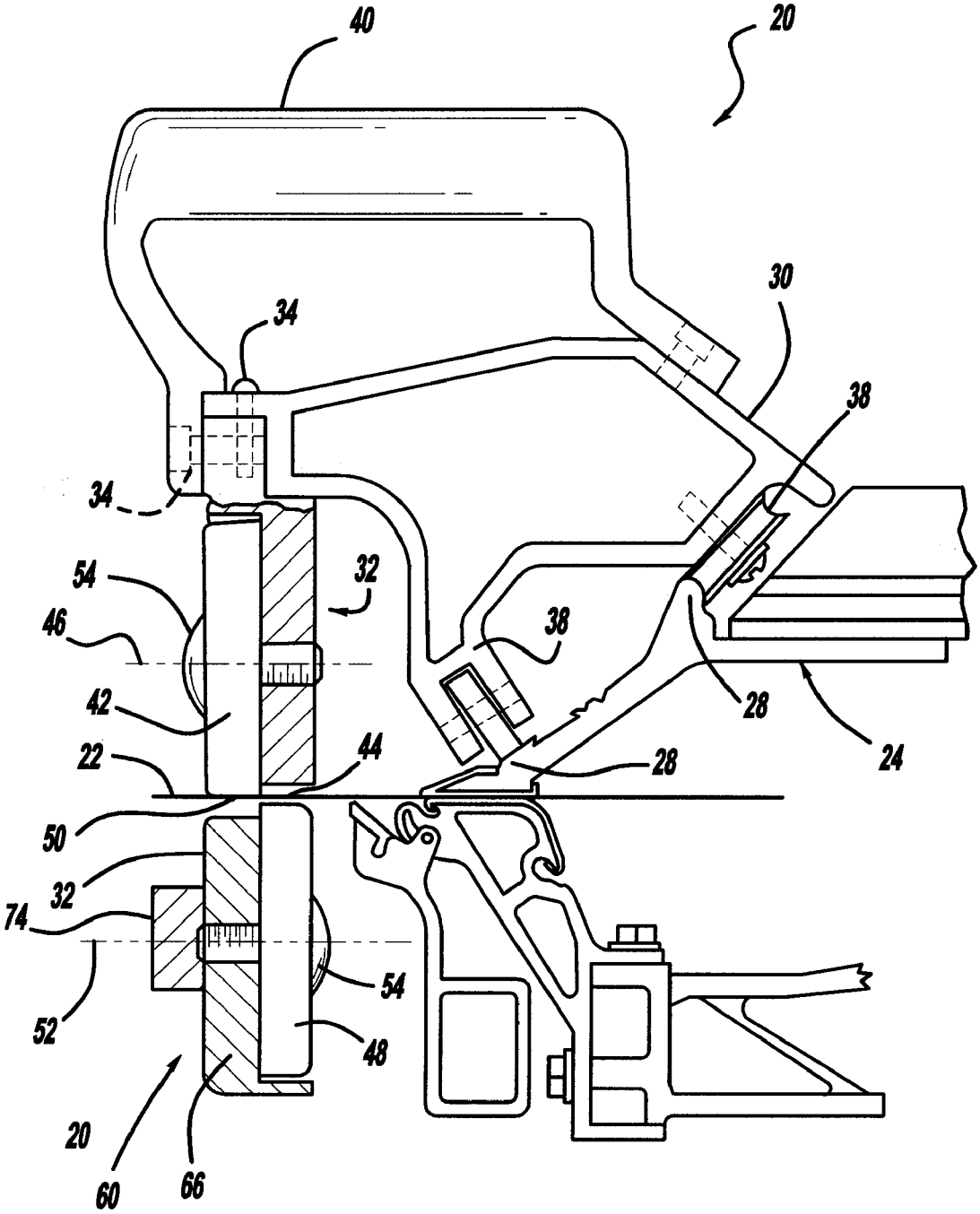
FIG. 2 is a fragmentary cross sectional view of the cutting assembly removably supported on the sheet bending brake.

Referring to FIG. 2, the cutting assembly 20 includes an extruded tubular frame 30. A cutter body 32 is supported by and attached to the tubular frame 30 by a plurality of screws 34. An anti-friction device 36 is attached to the tubular frame 30 for slideably engaging the track 28 on the sheet bending brake 24. The anti-friction device 36 includes a plurality of rollers 38 attached to the tubular frame for engaging the longitudinal track 28. The rollers guide the cutting assembly 20 as the cutting assembly 20 moves along the track 28. A handle 40 is connected to the tubular frame 30 to provide a worker with a convenient portion to grasp and operate the cutting assembly 20.

Figure 3:
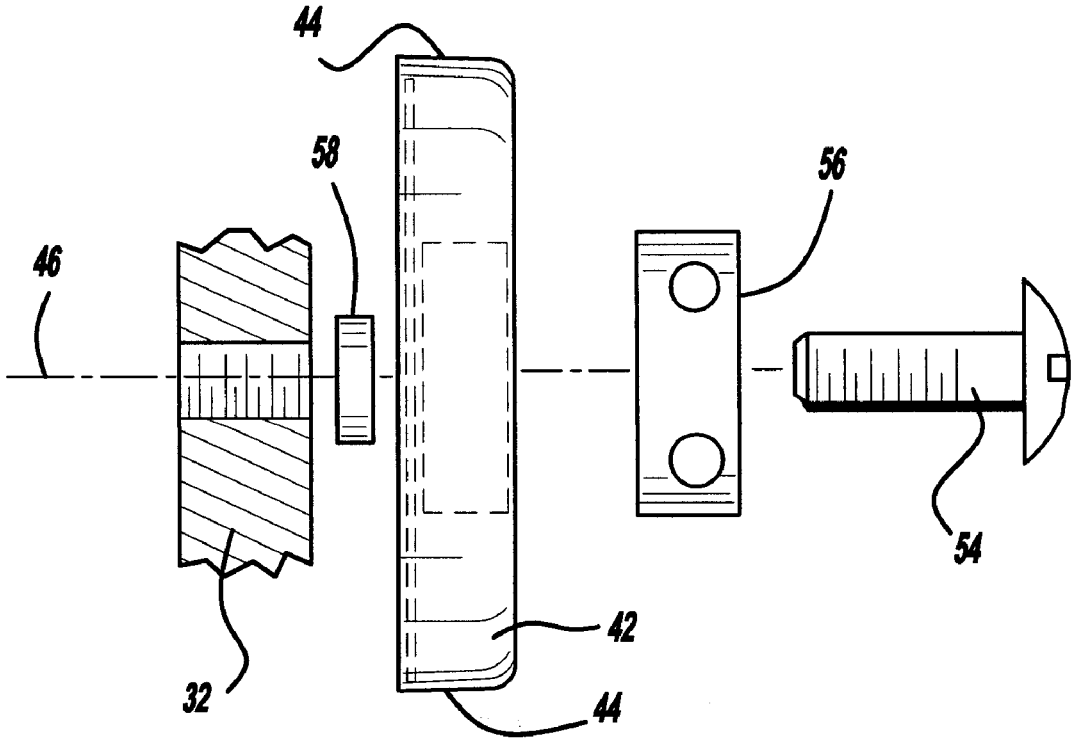
FIG. 3 is an exploded fragmentary cross sectional view of the first cutting disk rotatably attached to the cutter body.
Figure 4:
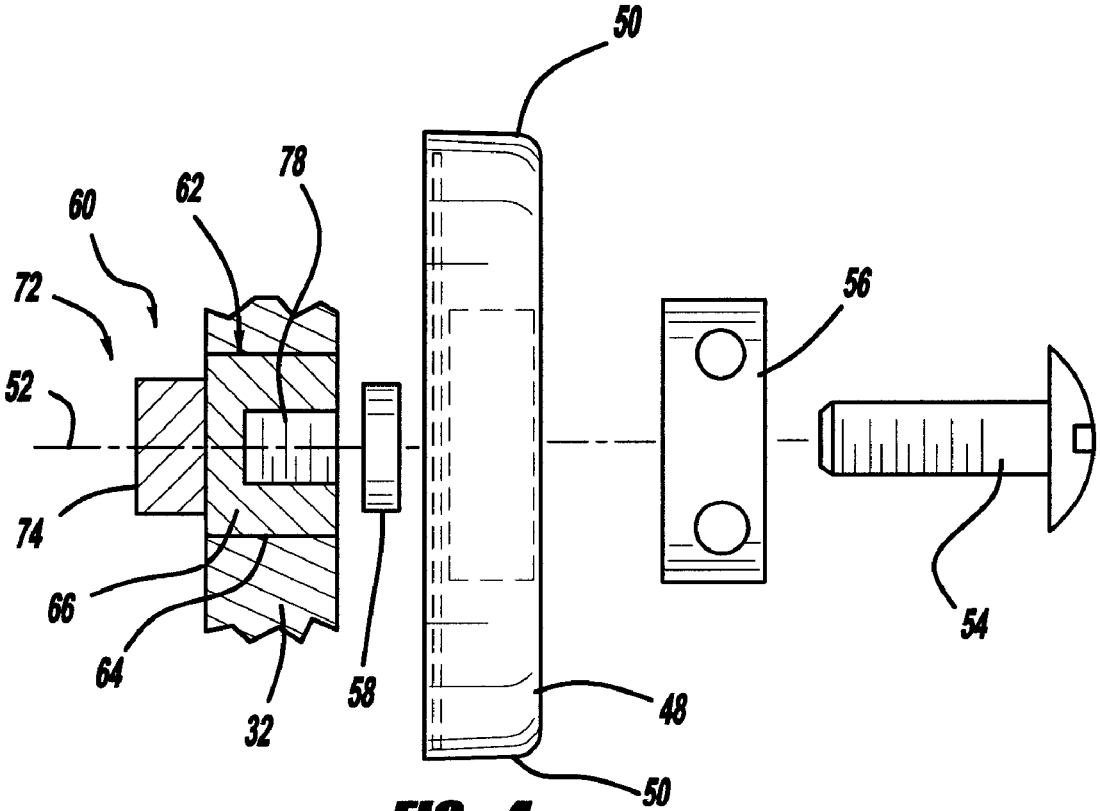
FIG. 4 is an exploded fragmentary cross sectional view of the second cutting disk rotatably attached to the cutter body and interconnected by a threaded insert.

Referring to FIGS. 3 and 4, the cutting assembly 20 includes a first cutting disk 42 having a periphery defining a primary cutting edge 44. The first cutting disk 42 is rotatably mounted to the cutter body 32 for rotation about a first axis 46. A second cutting disk 48 having a periphery defining a complimentary cutting edge 50 is rotatably mounted to the cutter body 32 for rotation about a second axis 52. The second axis 52 is parallel to and spaced from the first axis 46 for cutting the work piece 22 therebetween.

The first cutting disk 42 is attached to the cutter body 32 by a fastener 54 extending through the first cutting disk 42 and into threaded engagement with the cutter body 32. A roller bearing 56 is disposed between the first cutting disk 42 and cutter body 32 and concentric with the first cutting disk 42. An annular spacer 58 is disposed between the cutter body 32 and the roller bearing 56 and is concentric with the first cutting disk 42 and the roller bearing 56. The annular spacer 58 separates the first cutting disk 42 from the cutter body 32.

An adjustment mechanism, generally shown at 60, interconnects the second cutting disk 48 and the cutter body 32 for adjusting the complimentary cutting edge 50 axially along the second axis 52 relative to the primary cutting edge 44. The adjustment mechanism 60 allows for the easy adjustment of the second cutting disk 48, for cutting a plurality of work pieces 22, each having a different thickness and manufactured from a different material.

Referring to FIGS. 4 and 5, the adjustment mechanism 60 includes a threaded bore 62 defined by the cutter body 32. The threaded bore 62 includes a bore wall 64 and threads defined thereon. A threaded insert 66 having an outer surface 68 with threads defined thereon is in threaded engagement with the threaded bore 62. The threaded insert 66 includes a back surface 70 and a tool receiving device 72 therein. The tool receiving device 72 is for receiving a tool for operating the adjustment mechanism 60. The tool receiving device 72 includes a nut 74 protruding from the back surface 70 of the threaded insert 66. The worker may use a wrench (not shown) to rotate the threaded insert 66 into or out from the threaded bore 62. The complimentary cutting edge 50 is thereby adjusted axially relative to the primary cutting edge 44 along the second axis 52.

A roller bearing 56 is concentric with the second cutting disk 48 and disposed between the cutter body 32 and the second cutting disk 48. An annular spacer 58 is concentric with the second cutting disk 48 and disposed between the roller bearing 56 and the cutter body 32. The threaded insert 66 includes a front surface 76 having a cylindrical recess 78 therein. The cylindrical recess 78 includes a recess wall 80 having threads defined thereon. A fastener 54 extends through the second cutting disk 48, the roller bearing 56, and the annular spacer 58, and into threaded engagement with the cylindrical recess 78 for attaching the second cutting disk 48 to the threaded insert 66. The threaded insert 66 is in threaded engagement with the threaded bore 62, interconnecting the second cutting disk 48 and the cutter body 32.

Referring to FIG. 6, the adjustment mechanism 60 includes a locking device, generally shown at 82, for preventing movement of the adjustment mechanism 60 relative to the cutter body 32. The body includes a side wall 84 and a bottom wall 86. The locking device 82 includes a slot 88, defined by the cutter body 32, which extends between the side wall 84 and the threaded bore 62. A smooth bore 90 is defined by the cutter body 32 and extends upwardly form the bottom wall 86 to the slot 88. A locking recess 92 is concentric with the smooth bore 90 and extends upwardly from the slot 88 and away from the smooth bore 90. The locking recess 92 includes a threaded wall 94, defined by the cutter body 32, and threads defined thereon. A locking screw 96 having a smooth shank portion 98 extends form the bottom wall 86 to the slot 88. A threaded portion 100 of the locking screw 96 is in threaded engagement with the locking recess 92. The locking screw 96 secures the threaded insert 66 within the threaded bore 62 as the locking screw 96 is tightened against the cutter body 32.

The foregoing invention has been described in accordance with the relevant legal standards; thus, the description is exemplary rather than limiting in nature. Variations and modifications to the disclosed embodiment may become apparent to those skilled in the art and do come within the cope of the invention. Accordingly, the scope of legal protection afforded this invention can only be determined by studying the following claims. In addition, the reference numerals in the claims are merely for convenience and are not to be read in any way as limiting.

What is claimed is:

1. A cutting assembly (20) for cutting a work piece (22) on a sheet bending brake (24), said assembly comprising:

a cutter body (32);

a first cutting disk (42) having a periphery defining a primary cutting edge (44) and rotatably mounted to said cutter body (32) for rotation about a first axis (46);

a second cutting disk (48) having a periphery defining a complimentary cutting edge (50) substantially identical to the primary cutting edge (44) and rotatably mounted to said cutter body (32) for rotation about a second axis (52) spaced from said first axis (46) for cutting the work piece (22) therebetween; and an adjustment mechanism (60) directly interconnecting said second cutting disk (48) and said cutter body (32) in abutting relationship for adjusting said complimentary cutting edge (50) axially along said second axis (52) relative to said primary cutting edge (44) for cutting a plurality of work pieces (22) of different thickness and material.

2. An assembly as set forth in claim 1 wherein said assembly includes a locking device (82) for preventing movement of said adjustment mechanism (60) relative to said cutter body (32).

3. An assembly as set forth in claim 2 wherein said adjustment mechanism (60) includes a threaded bore (62) having a bore wall (64) including threads thereon and extends into said cutter body (32), and a threaded insert (66) having an outer surface (68) defining threads thereon in threaded engagement with said threaded bore (62).

4. An assembly as set forth in claim 3 wherein said threaded insert (66) includes a back surface (70) and a tool receiving device (72) therein for receiving a tool for rotating said threaded insert (66).

5. An assembly as set forth in claim 4 wherein said tool receiving device (72) includes a nut (74) protruding from said back surface (70) of said threaded insert (66).

6. An assembly as set forth in claim 4 wherein said cutter body (32) includes a side wall (84) and said locking device (82) includes a slot (88) defined by said cutter body (32) and extending between said side wall (84) and said threaded bore (62).

7. An assembly as set forth in claim 6 wherein said cutter body (32) includes a bottom wall (86) and said locking device (82) includes a smooth bore (90) defined by said cutter body (32) and extending upwardly from said bottom wall (86) to said slot (88).

8. An assembly as set forth in claim 7 wherein said locking device (82) includes a locking recess (92) concentric with said smooth bore (90) and extending upwardly from said slot (88) and away from said smooth bore (90) and including a threaded wall (94) having threads thereon and defined by said cutter body (32).

9. An assembly as set forth in claim 8 wherein said locking device (82) includes a locking screw (96) having a smooth shank portion (98) extending from said bottom wall (86) to said slot (88) and a threaded portion (100) in threaded engagement with said threaded locking recess (92).

10. An assembly as set forth in claim 9 wherein said assembly includes a roller bearing (56) concentric with said second cutting disk (48) and disposed between said cutter body (32) and said second cutting disk (48).

11. An assembly as set forth in claim 10 wherein said assembly includes an annular spacer (58) concentric with said second cutting disk (48) and disposed between said roller bearing (56) and said cutter body (32).

12. An assembly as set forth in claim 11 wherein said threaded insert (66) includes a front surface (76) having a cylindrical recess (78) therein and including a recess wall (80) having threads thereon and defined by said threaded insert (66).

13. An assembly as set forth in claim 12 wherein said assembly includes a fastener (54) extending through said second cutting disk (48) and said roller bearing (56) and said annular spacer (58) and into threaded engagement with said cylindrical recess (78) for attaching said second cutting disk (48) to said threaded insert (66).

14. An assembly as set forth in claim 13 wherein said first axis is parallel said second axis.

15. An assembly as set forth in claim 14 wherein said assembly includes a tubular frame (30) attached to said cutter body (32) for supporting said cutter body (32) on the sheet bending brake (24).

16. An assembly as set forth in claim 15 wherein said assembly includes an anti-friction device (36) attached to said tubular frame (30) for slideably engaging the sheet bending brake (24).

17. An assembly as set forth in claim 16 wherein said assembly includes a handle (40) attached to said tubular frame (30) for sliding said assembly along the sheet bending brake (24).

18. A sheet bending brake (24) comprising:

a base;

a clamping member (26) pivotally attached to said base for securing a work piece (22) thereto;

a track (28) extending longitudinally on said base; and a cutting assembly (20) removably supported by said track (28) and longitudinally movable on said track (28) for cutting the work piece (22);

said cutting assembly (20) including: a cutter body (32);

a first cutting disk (42) having a periphery defining a primary cutting edge (44) and rotatably mounted to said cutter body (32) for rotation about a first axis (46);

a second cutting disk (48) having a periphery defining a complimentary cutting edge (50) substantially identical to the primary cutting edge (44) and rotatably mounted to said cutter body (32) for rotation about a second axis (52) spaced from said first axis (46) for cutting the work piece (22) therebetween; and an adjustment mechanism (60) directly interconnecting said second cutting disk (48) and said cutter body (32) in abutting relationship for adjusting said complimentary cutting edge (50) axially along said second axis (52) relative to said primary cutting edge (44) for cutting a plurality of work pieces (22) of different thickness and material.

19. A sheet bending brake (24) as set forth in claim 18 wherein said cutting assembly (20) includes a locking device (82) for preventing movement of said adjustment mechanism (60) relative to said cutter body (32).

20. A sheet bending brake (24) as set forth in claim 19 wherein said adjustment mechanism (60) includes a threaded bore (62) having a bore wall (64) including threads thereon and extending into said cutter body (32), and a threaded insert (66) having an outer surface (68) defining threads thereon in threaded engagement with said threaded bore (62).

21. A sheet bending brake (24) as set forth in claim 20 wherein said threaded insert (66) includes a back surface (70) and a tool receiving device (72) therein for receiving a tool for rotating said threaded insert (66).

22. A sheet bending brake (24) as set forth in claim 21 wherein said tool receiving device (72) includes a nut (74) protruding from said back surface (70) of said threaded insert (66).

23. A sheet bending brake (24) as set forth in claim 22 wherein said cutter body (32) includes a side wall (84) and said locking device (82) includes a slot (88) defined by said cutter body (32) and extending between said side wall (84) and said threaded bore (62).

24. A sheet bending brake (24) as set forth in claim 23 wherein said cutter body (32) includes a bottom wall (86) and said locking device (82) includes a smooth bore (90) defined by said cutter body (32) and extending upwardly from said bottom wall (86) to said slot (88).

25. A sheet bending brake (24) as set forth in claim 24 wherein said locking device (82) includes a locking recess (92) concentric with said smooth bore (90) and extending upwardly from said slot (88) and away from said smooth bore (90) and including a threaded wall (94) having threads thereon and defined by said cutter body (32).

26. A sheet bending brake (24) as set forth in claim 25 wherein said locking device (82) includes a locking screw (96) having a smooth shank portion (98) extending from said bottom wall (86) to said slot (88) and a threaded portion (100) in threaded engagement with said threaded locking recess (92).

27. A sheet bending brake (24) as set forth in claim 26 wherein said cutting threaded insert (66) includes a front surface (76) having a cylindrical recess (78) therein and including a recess wall (80) having threads thereon defined by said threaded insert (66).

28. A sheet bending brake (24) as set forth in claim 27 wherein said cutting assembly (20) includes a fastener (54) extending through said second cutting disk (48) into threaded engagement with said cylindrical recess (78) for attaching said second cutting disk (48) to said threaded insert (66).

29. A cutting assembly (20) for cutting a work piece (22) on a sheet bending brake (24), said assembly comprising:

a cutter body (32);

a first cutting disk (42) having a periphery defining a primary cutting edge (44) and rotatably mounted to said cutter body (32) for rotation about a first axis (46);

a second cutting disk (48) having a periphery defining a complimentary cutting edge (50) and rotatably mounted to said cutter body (32) for rotation about a second axis (52) spaced from said first axis (46) for cutting the work piece (22) therebetween; and an adjustment mechanism (60) interconnecting said second cutting disk (48) and said cutter body (32) for adjusting said complimentary cutting edge (50) axially along said second axis (52) relative to said primary cutting edge (44) for cutting a plurality of work pieces (22) of different thickness and material;

wherein said assembly includes a locking device (82) for preventing movement of said adjustment mechanism (60) relative to said cutter body (32);

wherein said adjustment mechanism (60) includes a threaded bore (62) having a bore wall (64) including threads thereon and extends into said cutter body (32), and a threaded insert (66) having an outer surface (68) defining threads thereon in threaded engagement with said threaded bore (62);

wherein said threaded insert (66) includes a back surface (70) and a tool receiving device (72) therein for receiving a tool for rotating said threaded insert (66);

wherein said cutter body (32) includes a side wall (84) and said locking device (82) includes a slot (88) defined by said cutter body (32) and extending between said side wall (84) and said threaded bore (62);

wherein said cutter body (32) includes a bottom wall (86) and said locking device (82) includes a smooth bore (90) defined by said cutter body (32) and extending upwardly from said bottom wall (86) to said slot (88);

wherein said locking device (82) includes a locking recess (92) concentric with said smooth bore (90) and extending upwardly from said slot (88) and away from said smooth bore (90) and including a threaded wall (94) having threads thereon and defined by said cutter body (32);

wherein said locking device (82) includes a locking screw (96) having a smooth shank portion (98) extending from said bottom wall (86) to said slot (88) and a threaded portion (100) in threaded engagement with said threaded locking recess (92);

wherein said assembly includes a roller bearing (56) concentric with said second cutting disk (48) and disposed between said cutter body (32) and said second cutting disk (48);

wherein said assembly includes an annular spacer (58) concentric with said second cutting disk (48) and disposed between said roller bearing (56) and said cutter body (32);

wherein said threaded insert (66) includes a front surface (76) having a cylindrical recess (78) therein and including a recess wall (80) having threads thereon and defined by said threaded insert (66).

30. An assembly as set forth in claim 29 wherein said tool receiving device (72) includes a nut (74) protruding from said back surface (70) of said threaded insert (66).

31. An assembly as set forth in claim 29 wherein said assembly includes a fastener (54) extending through said second cutting disk (48) and said roller bearing (56) and said annular spacer (58) and into threaded engagement with said cylindrical recess (78) for attaching said second cutting disk (48) to said threaded insert (66).

32. An assembly as set forth in claim 31 wherein said first axis is parallel said second axis.

33. An assembly as set forth in claim 29 wherein said assembly includes a tubular frame (30) attached to said cutter body (32) for supporting said cutter body (32) on the sheet bending brake (24).

34. An assembly as set forth in claim 33 wherein said assembly includes an anti-friction device (36) attached to said tubular frame (30) for slideably engaging the sheet bending brake (24).

35. An assembly as set forth in claim 34 wherein said assembly includes a handle (40) attached to said tubular frame (30) for sliding said assembly along the sheet bending brake (24).

* * * * *